US011957966B2

(12) United States Patent
Laser

(10) Patent No.: US 11,957,966 B2
(45) Date of Patent: Apr. 16, 2024

(54) SPRING RING DEVICE FLYING DISC APPARATUS

(71) Applicant: JLASER, LLC, Norwich, VT (US)

(72) Inventor: John Eric Laser, Norwich, VT (US)

(73) Assignee: JLASER LLC, Norwich, CT (US)

( * ) Notice: Subject to any disclaimer, the term of this patent is extended or adjusted under 35 U.S.C. 154(b) by 0 days.

(21) Appl. No.: 18/109,189

(22) Filed: Feb. 13, 2023

(65) Prior Publication Data

US 2023/0191216 A1 Jun. 22, 2023

Related U.S. Application Data

(63) Continuation of application No. 17/838,097, filed on Jun. 10, 2022, now Pat. No. 11,577,134.

(60) Provisional application No. 63/219,296, filed on Jul. 7, 2021.

(51) Int. Cl.
*A63B 65/10* (2006.01)
*A63H 33/18* (2006.01)

(52) U.S. Cl.
CPC ..... *A63B 65/10* (2013.01)

(58) Field of Classification Search
CPC . A63B 65/10; A63B 2208/12; A63B 2210/54; A63H 33/18
USPC ..... 446/46, 48; 473/588, 589
See application file for complete search history.

(56) References Cited

U.S. PATENT DOCUMENTS 3,359,678 A * 12/1967 Headrick ..... A63H 33/18 473/589
3,742,643 A * 7/1973 Keith ..... A63H 27/12 446/46
3,765,122 A * 10/1973 English ..... A63H 33/18 473/589
3,939,602 A * 2/1976 Burke ..... A63H 33/18 446/48
4,112,612 A * 9/1978 Woods ..... A63H 33/18 473/589
4,204,357 A * 5/1980 Harrington ..... A63H 33/18 473/588
4,205,484 A * 6/1980 Kovac ..... A63H 33/18 446/46
4,223,473 A * 9/1980 Brown ..... A63H 33/18 446/46

(Continued)

FOREIGN PATENT DOCUMENTS

CN 201668962 U 12/2010
WO 2007042741 A1 4/2007

(Continued)

*Primary Examiner* — Alexander R Niconovich
(74) *Attorney, Agent, or Firm* — Trojan Law Offices

(57) ABSTRACT

Disclosed herein is a spring ring device having a unique ability to bounce and rebound off hard surfaces while maintaining a continued flight path, acting as if it had just been thrown back to the thrower after ricocheting off a wall. The spring ring device will bounce off one or multiple surfaces and can be caught by the same or a different player. The spring ring device generally includes a ring, a ring cover configured to encase the ring. The spring ring device may also include a shell configured to cover at least a portion of the ring cover. The unique structure of the spring ring device allows the device to bounce and rebound off hard surfaces and maintain a continued flight path.

19 Claims, 4 Drawing Sheets

(56) References Cited

U.S. PATENT DOCUMENTS 4,241,533 A * 12/1980 Newsome ..... A63H 33/18 D21/443
4,288,942 A * 9/1981 Nicholl ..... A63H 33/18 473/588
4,290,226 A * 9/1981 Stauffer ..... A63H 33/18 473/588
4,315,629 A * 2/1982 English ..... A63H 33/18 473/589
4,351,129 A * 9/1982 Kerkenbush ..... A63H 33/18 446/46
4,356,660 A * 11/1982 O'Brien ..... A63B 67/086 446/256
4,503,635 A * 3/1985 Harrington ..... A63H 33/18 473/588
4,681,553 A * 7/1987 Rodarte ..... A63H 33/18 446/46
4,832,652 A * 5/1989 Matsuyama ..... A63F 9/0278 446/397
4,889,347 A * 12/1989 Mineart ..... A63H 33/18 473/588
4,944,707 A * 7/1990 Silverglate ..... A63H 33/18 446/48
4,955,841 A * 9/1990 Pastrano ..... A63H 33/18 473/588
4,979,922 A * 12/1990 Clark ..... A63H 33/18 473/588
5,030,157 A * 7/1991 Silverglate ..... A63H 33/18 446/36
5,078,637 A * 1/1992 McFarland ..... A63H 33/18 473/588
5,261,846 A * 11/1993 Hanna ..... A63H 33/18 446/46
5,263,819 A * 11/1993 O'Leary ..... A63H 33/18 446/46
5,326,299 A * 7/1994 Jasinski ..... A63H 33/18 D21/443
5,358,440 A * 10/1994 Zheng ..... A63H 33/18 446/487
5,366,403 A * 11/1994 Weiss ..... A63H 33/18 473/588
5,490,806 A * 2/1996 Spector ..... A63H 33/18 446/236
5,540,610 A * 7/1996 Sneddon ..... A63H 33/18 446/236
5,676,581 A * 10/1997 Ziegler ..... A63H 33/18 446/46
5,800,237 A * 9/1998 Cummings ..... A63H 33/18 473/589
5,816,879 A * 10/1998 Kyame ..... A63H 33/18 473/589
5,853,311 A * 12/1998 Bartholomew ..... A63H 33/18 473/588
6,113,453 A * 9/2000 Stuffelbeam ..... A63H 33/18 446/236
6,174,214 B1 * 1/2001 Cooper ..... A63H 33/18 473/588
6,390,879 B1 * 5/2002 Spector ..... A63H 33/18 473/588
6,468,123 B1 * 10/2002 Valencia ..... A63H 33/18 473/588
6,585,551 B2 * 7/2003 McClung ..... A63H 33/18 473/588
6,595,823 B2 * 7/2003 Huset ..... A63H 33/18 446/253
6,682,384 B2 * 1/2004 Wang ..... A63H 33/18 446/46
6,726,521 B2 * 4/2004 Peterson ..... A63H 33/18 446/46
6,939,191 B1 * 9/2005 Wu ..... A63H 33/18 446/46
7,007,290 B2 * 2/2006 Wilcoxson ..... G11B 33/0422
7,096,826 B2 * 8/2006 Markham ..... A01K 15/025 119/707
7,270,588 B2 * 9/2007 Frazier ..... A63H 33/18 473/589
8,241,153 B2 * 8/2012 Williams ..... A63B 60/06 473/588
8,246,497 B1 * 8/2012 Garcia ..... A63B 65/00 473/589
9,731,216 B2 * 8/2017 Richardson ..... A63H 33/18
9,914,069 B2 * 3/2018 Lehman ..... A63H 33/18
10,399,000 B1 * 9/2019 Fisher ..... A63H 33/18
10,610,800 B2 * 4/2020 Adkins ..... A63F 9/0278
2004/0166764 A1 * 8/2004 Stark ..... A63H 33/18 446/46
2004/0205807 A1 * 10/2004 Wilcoxson ..... F41J 1/01 473/588
2006/0073758 A1 * 4/2006 Goodwin ..... A63B 59/30 446/48
2006/0141896 A1 * 6/2006 Owens ..... A63H 33/18 446/48
2006/0189246 A1 * 8/2006 Stark ..... A63H 33/18 446/46
2008/0064289 A1 * 3/2008 McAnulty ..... A63H 33/18 446/46
2009/0176435 A1 * 7/2009 Stark ..... A63H 33/18 446/46
2009/0176436 A1 * 7/2009 Stark ..... A63H 33/18 446/46
2020/0276508 A1 * 9/2020 Blumenfeld ..... A63H 33/18
2023/0090692 A1 * 3/2023 Stark ..... A63H 33/18 446/400

FOREIGN PATENT DOCUMENTS

WO 2010082117 7/2010
WO 2014047774 4/2014

* cited by examiner

SPRING RING DEVICE FLYING DISC APPARATUS

CROSS RELATED APPLICATIONS

This application is a continuation of U.S. patent application Ser. No. 17/838,097 entitled "Spring Ring Device," filed Jun. 10, 2022, which claims priority to U.S. Provisional Patent Application 63/219,296 entitled "Bouncing Disc that Flies," filed Jun. 25, 2021, both of which are incorporated by reference herein in their entirety.

FIELD OF THE INVENTION

The present invention relates generally to a device that, when thrown or projected, is able to ricochet or bounce repeatedly off of one or more hard surfaces and continue its flight until caught or grounded. The present invention further relates to uses of the device, such as games using the device or physical therapy using the device.

BACKGROUND OF THE INVENTION

Hand thrown flying toys, in particular flying discs, are popular recreational toys used for an array of sports such as disc golf, ultimate FRISBEE™, distance throwing, or canine disc sports. However, current flying discs do not have the ability to bounce or ricochet off hard surfaces in a manner conducive to continued flight. Instead, upon impact, these flying discs experience oscillations and a slowed rotation, which destabilize the disc and inhibit the flight path.

Document WO 2010/082117A1 describes a bouncing disc formed by two hemispheres made of an elastic and transparent material. It is made of two identical discs that are superposed against one another, forming a single unit that bounces when thrown against one or multiple hard surfaces. However, this bouncing disc is incapable of long-distance flights due to the shape of the bouncing disc.

Document WO 2007/042741 describes a bouncy ring that embodies a series of identical elastic rings meant to be thrown against a surface and bounce back, allowing it to be caught by a player. The bouncy ring does not have a surface allowing the bouncy ring to glide. Thus, this bouncy ring is incapable of long-distance flights as its structure does not provide sufficient glide.

U.S. Pat. No. 3,359,678 depicts a traditional flying disc. The traditional flying disc has a saucer shape that is configured to fly and glide long distances. Due to the construction of this traditional flying disc, the disc will develop oscillations upon impact. Thus, the traditional flying disc is incapable of rebounding and bouncing off hard surfaces without destabilizing the flight of the disc.

U.S. Pat. No. 5,358,440, filed on Oct. 25, 1994, describes a collapsible flying disc that is made up of a flexible ring and sheathed in a light material that enables flight like a traditional flying disc. Although the ring's elastic limit is high, it is too flexible to achieve a fully sustained bounce off a hard surface.

Thus, there is a need for a device that when thrown or projected is capable of flying and gliding, while simultaneously rebounding and bouncing off one or more hard surfaces without destabilizing the flight of the device that is typically caused by an impact to a hard surface.

SUMMARY OF THE INVENTION

Disclosed herein is a spring ring device having a unique ability to bounce and rebound off one or more hard surfaces and maintain a continued flight path, acting as if it had just been thrown back to the thrower. The spring ring device is capable of bouncing off one or multiple surfaces and can be caught by the same or a different player.

In one embodiment, the spring ring device includes a ring, a ring cover configured to encase the ring, and a shell configured to cover at least a portion of the ring cover. In this embodiment, the ring cover extends across the entire central area of the ring to create a device capable of flying and gliding and bouncing off hard surfaces while continuing its flight. In another embodiment, the spring ring device includes a ring and a ring cover configured to encase the ring. In this embodiment, the ring cover extends across the entire central area of the ring to create a device capable of flying and gliding and bouncing off hard surfaces while continuing its flight. In another embodiment, the spring ring device includes a ring, a plate, at least one flexible link, and a shell. In this embodiment the plate is smaller in diameter than the ring and sits within the circumference of the ring. The plate is connected to the ring by the at least one flexible link. The shell covers and protects the entire device.

Further disclosed herein are multiple uses for the spring ring device. The spring ring device may be utilized to modify existing games which use a disc-like device. The spring ring device may also be utilized to create new games incorporating the ability of the device to bounce and ricochet off hard surfaces. The spring ring device may also be used for therapeutic purposes, such as to improve motor function and hand-eye coordination in patients needing physical therapy.

BRIEF DESCRIPTION OF THE DRAWINGS

These and other features and advantages of the present invention will become appreciated, as the same becomes better understood with reference to the specification, claims and drawings herein:

DETAILED DESCRIPTION OF THE INVENTION

Figure 1:
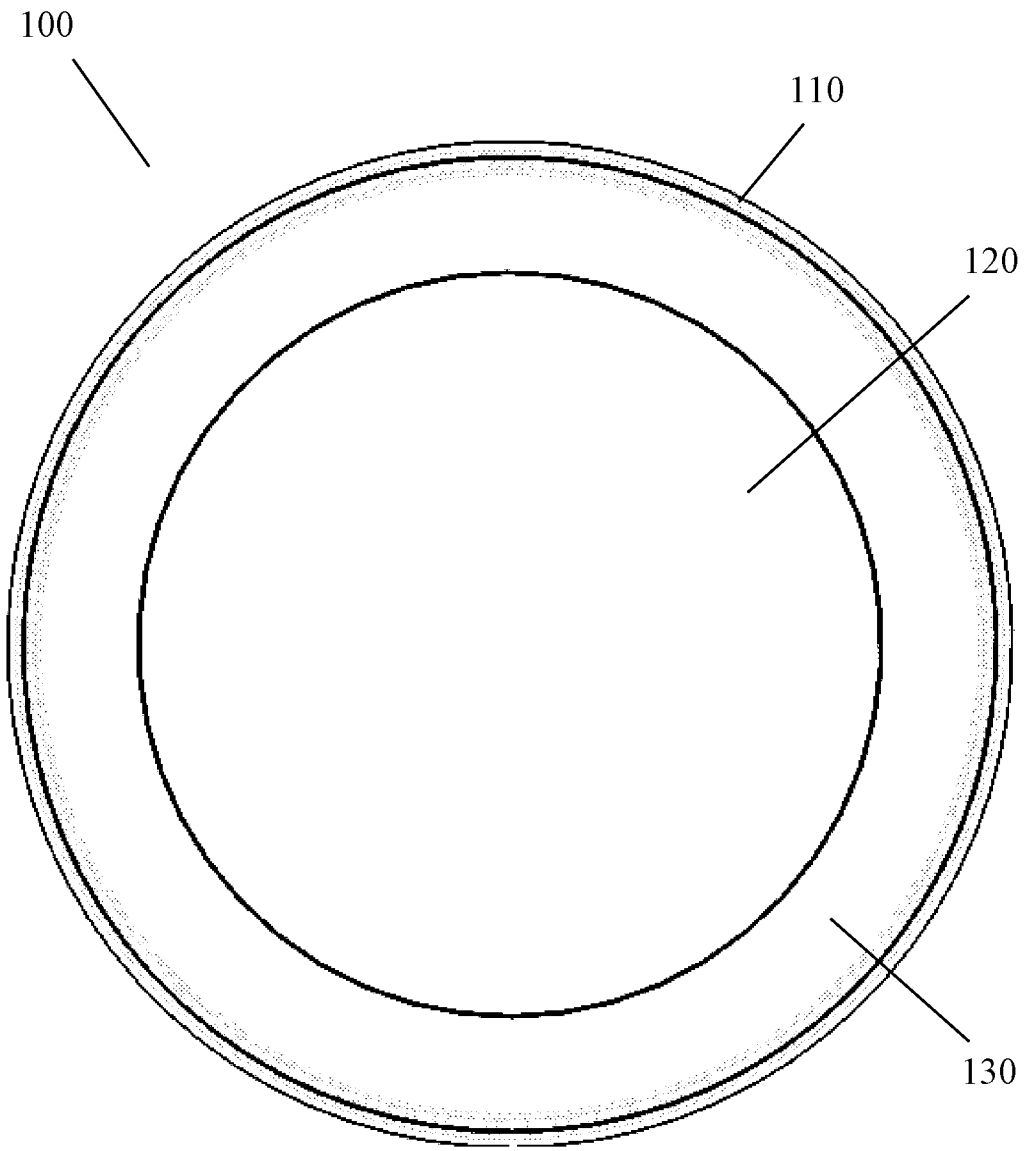
FIG. 1 is a top view of the spring ring device in accordance with a first embodiment of the present invention.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present there between. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section.

As used herein, the singular forms "a," "an," and "the," are intended to include the plural forms as well, unless the context clearly indicates otherwise. It will be further understood that the terms "comprises" and/or "comprising," "includes" and/or "including," and "have" and/or "having," when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," and "upper" or "top," and "inner" or "outer," may be used herein to describe one element's relationship to another elements as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Disclosed herein is a spring ring device that is capable of flying and gliding while simultaneously rebounding and bouncing off hard surfaces without destabilizing the flight of the device. The unique configuration of the device allows the device to fly and/or glide for long distances and rebound off hard surfaces at distances which exceed 50 feet. The device is capable of rebounding off a single hard surface or multiple surfaces and be caught by a different player or the same player who threw originally threw the device. While multiple embodiments of the spring ring device are described below, other variations of the spring ring device may be created without departing from the concepts disclosed herein.

A first embodiment of the spring ring device 100 is depicted in FIG. 1. The device 100 is generally made up of three components. The first component is a ring 110, which was previously referred to as a "first component" or "ring" in the provisional application. The second component is a ring cover 120, which was previously referred to as an "inner section" in the provisional application. The third component is a shell 130, which was previously referred to as an "outer layer" in the provisional application. The ring 110, ring cover 120, and shell 130 are equivalent to the first component, inner section, and outer layer from the provisional application respectively.

As shown in the first embodiment, the device 100 is generally round in shape. In a preferred embodiment, the device 100 is circular when viewed from above. In other embodiments, the device 100 may be other rounded shapes without departing from the concepts disclosed herein.

Figure 2A:
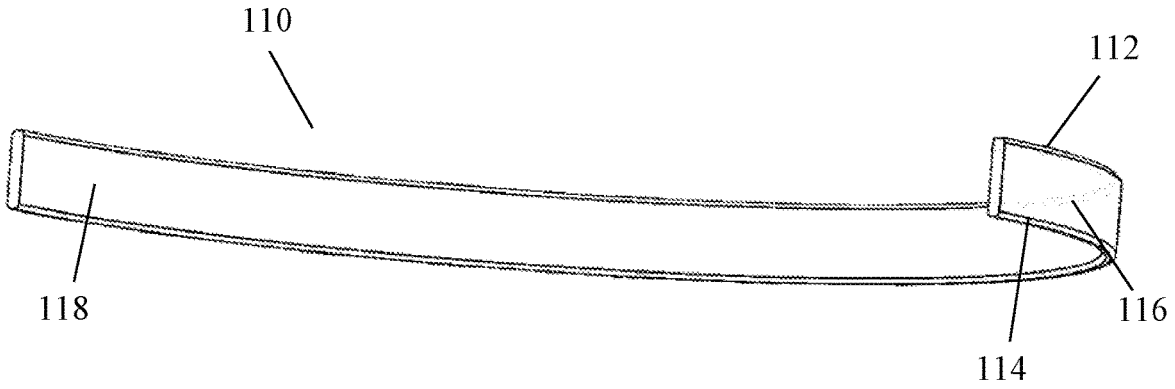
FIG. 2A is a side perspective view of a cross-section of the ring of the spring ring device of FIG. 1.
Figure 2B:
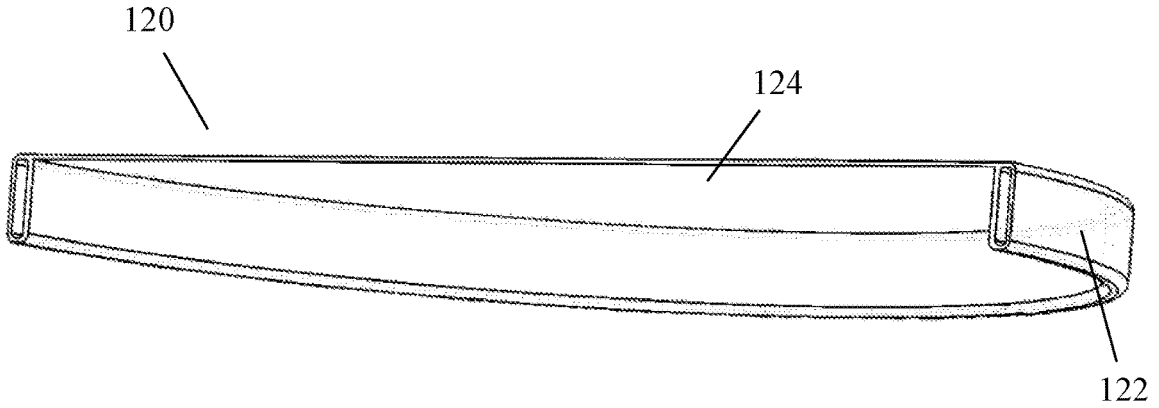
FIG. 2B is a side perspective view of a cross-section of the ring cover of the spring ring device of FIG. 1.
Figure 2C:
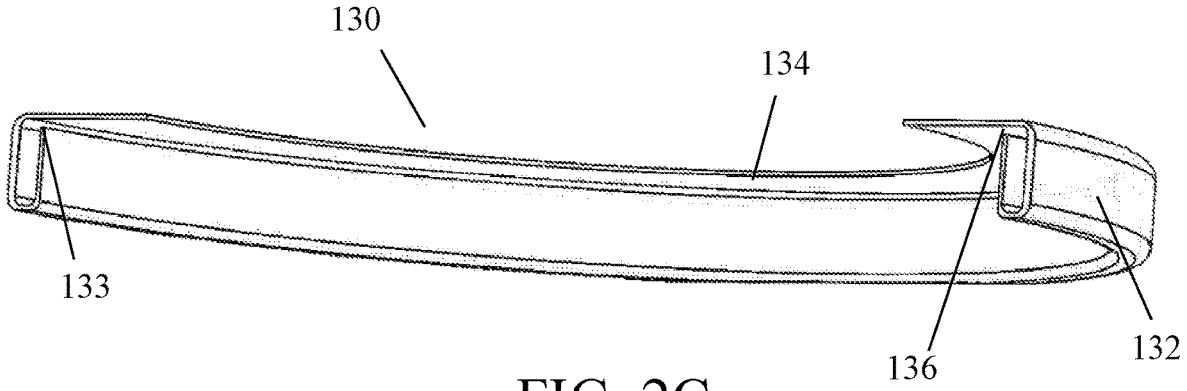
FIG. 2C is a side perspective view of a cross-section of the shell of the spring ring device of FIG. 1.

FIGS. 2A-2C depict cross-sectional side perspective views of each component of the spring ring device 100 in accordance with the first embodiment. FIG. 2A depicts a cross-sectional side perspective view of the ring 110 of the device 100. FIG. 2B depicts a cross-sectional side perspective view of the ring cover 120 of the device 100. FIG. 2A depicts a cross-sectional side perspective view of the shell 130 of the device 100.

As depicted in FIG. 2A, the device 100 includes a ring 110. The ring 110 acts as a spring in order to provide the device 100 with the capability to rebound and bounce off hard surfaces. In a preferred embodiment, the ring 110 is constructed out of a lightweight material with a high elasticity to provide the springing capabilities. For example, the ring 110 may be constructed out of fiberglass, plastics, and certain types of metal alloys having a high elasticity. While the listed materials may be used to construct the ring 110, any material having sufficient elasticity to spring off hard surfaces may be utilized without departing from the concepts disclosed herein.

The ring 110 may be circular in shape when viewed from the top. In a preferred embodiment, the ring 110 is circular with an open space in the center when viewed from above. The ring 110 includes a top 112, a bottom 114, an outer edge 116, and an inner edge 118. In some embodiments, the ring 110 is a torus shape, where the top 112, bottom 114, outer edge 116, and inner edge 118 are all rounded. In other embodiments, the ring 110 is a straight-edge hollow cylinder shape, where the top 112, bottom 114, outer edge 116, and inner edge 118 are substantially flat, forming a cylinder with an opening in the middle. In other embodiments, such as the embodiment depicted in FIG. 2A, the top 112 and bottom 114 are rounded in shape, while the outer edge 116 and inner edge 118 are substantially flat in shape. Other shapes and combinations of the aforementioned shapes may be utilized as well without departing from the concepts disclosed herein. The ring 110 is configured to have an open space in the central area of the ring 110.

The ring 110 may be any diameter and any thickness so long as it remains lightweight enough to maintain flight and glide while simultaneously keeping a high coefficient of restitution, allowing it to bounce off hard surfaces and maintain its shape. Any area density may also be utilized without departing from the concepts disclosed herein. The optimal area density for the ring 110 to achieve the longest bounce and flight performance is between 1.2 $g/cm^2$ and 1.5 $g/cm^2$. Thus, in preferred embodiments, the diameter and weight of the ring 110 fits within this ratio.

As depicted in FIG. 2B, the device 100 also includes a ring cover 120. The ring cover 120 generally includes a ring casing portion 122 and a top cover portion 124. The ring casing portion 122 is generally the same shape as the ring 110 such that the ring casing portion 122 is capable of fully encasing the ring 110. The top cover portion 124 of the ring cover 120 extends across the entirety of the center area inside the diameter of the ring casing portion 122. With this configuration, once the ring cover 120 encases the ring 110, the top cover portion 124 of the ring cover 120 extends across the entire open space in the central area of the ring 110.

In a preferred embodiment, the ring cover 120 is a single-piece construction and constructed out of a single type of material. In other embodiments, the ring cover 120 may be a multi-piece construction and/or made of more than one material. Materials that may be used to construct the ring cover 120 include synthetic fabrics (such as nylon fabric, polyester fabric, and polypropylene fabric), polyurethanes, and rubber. Other similar materials may also be used to construct the ring cover 120 without departing from the concepts disclosed herein, so long as the material is flexible and lightweight, allowing for the device 100 to bounce off hard surfaces when thrown.

To ensure the best flight and bounce performance, the top cover portion 124 of the ring cover 120 should tightly span the open space in the central area of the ring 110. Thus, the diameter and circumference of the top cover portion 124 should be substantially the same as the diameter and circumference of the ring casing portion 122 and the ring 110. The presence of the top cover portion 124 provides the device 100 with the ability to fly and glide long distances when thrown or projected, while the configuration of the ring cover 120 and ring 110 provide a flexible design so the device 100 does not develop oscillations when hitting a hard surface. Thus, the device 100 will return to its original shape immediately after impact.

As depicted in FIG. 2C, the device 100 may also include a shell 130. The shell 130 generally has a ring shell 132, a top portion 134, and a channel 136. As shown in FIG. 2C, the ring shell 132 is configured to generally match the shape of the ring 110 and be larger than the ring 110 such that the ring shell 132 is capable of covering both the ring 110 and ring casing 122. The top portion 134 of the shell 130 may extend inward over a portion of the top cover portion 124 of the ring casing 120. While FIG. 2C depicts the top portion 134 of the shell 130 extending inward at a distance to cover only a portion of the top cover portion 124, the distance covered inward may vary in other embodiments of the device 100. For example, the top portion 134 may extend to cover the entire top cover portion 124, may not extend beyond the ring casing 122, or may extend inward to any position in between.

The shell 130 is configured to provide additional grip and protection to the device 100 from impacts with hard surfaces. The additional grip provided by the shell 130 allows a player to more easily throw and catch the device 100. Further, the shell 130 should be constructed out of a material that is capable of protecting the device 100 from damage upon impact with a hard surface. Thus, the materials used for the shell 130 should preferably be flexible, durable, and lightweight. For example, possible materials for the shell 130 include plastics, rubbers, and other composites such as fiberglass or carbon fiber. Other materials may also be used without departing from the concepts disclosed herein.

The shell 130 can be any size so long as it is capable of securely fitting around the ring 110 and ring cover 120. Any thickness for the shell 130 can be used without departing from the concepts disclosed herein, so long as the thickness of the shell 130 does not prevent the device 100 from flying and gliding. The thickness of the shell 130 may vary depending on the application and size of the device 100.

The shell 130 also includes a channel 136 placed between the ring shell end 133 and the bottom of the top shell portion 134. This channel 136 is configured to allow the ring 110 and ring cover 120 to be inserted into the shell 130. Thus, the channel 136 may be of any size sufficient to allow the insertion of the ring 110 and ring cover 120 into the shell 130.

Figure 3:
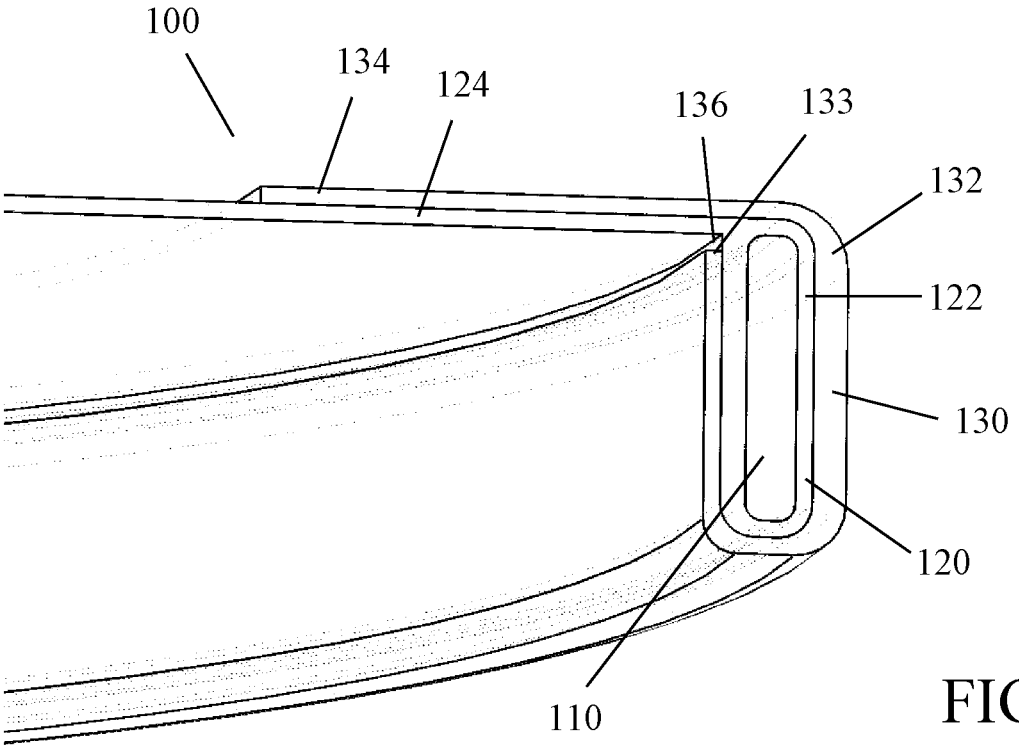
FIG. 3 is a cross-section view of the spring ring device of FIG. 1.

FIG. 3 depicts the components of the device 100 assembled together. The ring cover 120 is configured to fully encase the ring 110 on all sides, including the top 112, bottom 114, outer edge 116, and inner edge 118. The top cover portion 124 then extends inward from the ring 110 to fully cover the open space at the central area of the ring 110, providing the top cover portion 124 for the device 100. The ring cover 120 can encase the ring 110 through various methods depending on the material selected.

For example, if a synthetic fabric is chosen for construction of the ring cover 120, the ring cover 120 is attached to the ring 110 by first placing a continuous piece of fabric over the ring 110 such that the fabric contacts the top 112 of the ring 110. Then the fabric is wrapped around the outer edge 116, the bottom 114, and the inner edge 118 of the ring 110 and is then sewn it back to itself, forming the ring casing 122. The fabric may be sewn back to itself at the location where the ring cover 120 contacts the top 112 of the ring 110, to the top cover portion 124 of the ring cover 120, or any other location that results in the complete encasing of the ring 110 by the ring cover 120. If using fabric, the material must be pulled tight at the top cover portion 124 and ring casing portion 122 to ensure best flight, glide, and bounce performance.

If a plastic or rubber material is chosen for construction of the ring cover 120, the ring casing 122 is formed and molded to match the shape of the ring 110, and the top cover portion 124 is configured to extend across and cover the entirety of the central area of the ring 110. The ring cover 120 is then fused to the ring 110 via heat or other fusing means, thereby completely encasing the ring 110 as shown in FIG. 3.

Once the ring cover 120 fully encases the ring 110, the shell 130 may then be secured to the device 100. The shell 130 is wrapped around the ring cover 120 encasing the ring 110 by inserting the ring cover 120 and ring 110 into the shell 130 through the channel 136. Once the ring cover 120 and ring 110 are inserted into the shell 130 through the channel 136, then the shell 130 may be affixed to the ring cover 120 encasing the ring 110 by any means. For example, the shell 130 may be attached to the ring cover 120 by needle and thread, adhesives, or thermal bonding. Other means of attachment may be utilized as well without departing from the concepts disclosed herein.

Once the shell 130 is affixed to the ring cover 120, the device 100 will be formed as depicted in FIG. 3. The ring 110 is fully encased by the ring cover 120. The ring cover 120 has the top cover portion 124 that extends across the entire open space at the central area of the ring 110. This forms a top cover portion 124 to the device 100 that allows for long distance flight and glide. The shell 130 covers substantially all the ring casing 122 of the ring cover 120 (except at the channel 136) and extends inward to cover a portion of the top cover portion 124 of the ring cover 120. As such, the shell 130 is configured to cover at least a portion of the ring cover 120. This unique configuration of the ring 110, ring cover 120, and shell 130 allow for the device 100 to fly and glide long distances, while simultaneously being able to bounce and rebound off hard surfaces when thrown without destabilizing the flight or glide of the device 100.

Figure 4:
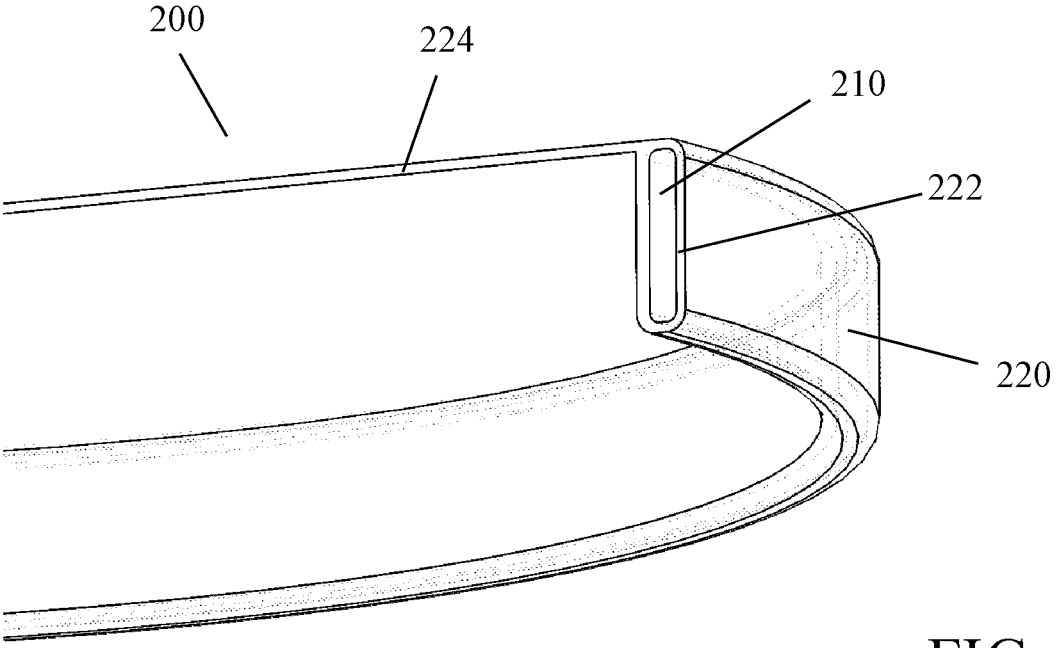
FIG. 4 is a cross-section view of the spring ring device in accordance with a second embodiment of the present invention.

A second embodiment of the device 200 is depicted in FIG. 4. The second embodiment of the device 200 is identical to the first embodiment of the device 100 except that the shell 130 from the first embodiment is not utilized. As such, the second embodiment of the device 200 generally includes a ring 210 and a ring cover 220. The ring cover 220 is configured to fully encase the ring 210 and extend across the open space at the central area of the ring 210. The inventive concepts disclosed for the first embodiment with respect to the ring 110 and ring cover 120 equally apply to the second embodiment and are thus incorporated by reference for the second embodiment of the device 200.

The second embodiment may be used when the material selected for the ring cover 220 is sufficiently durable to provide the grip and protection that is provided by the shell 130 in the first embodiment. When such a material is used for the ring cover 220, the ring cover 220 itself will provide the grip and impact protection such that the device 200 is able to fly and glide long distances, while simultaneously being able to bounce and rebound off hard surfaces when thrown without destabilizing the flight or glide of the device 200.

Figure 5:
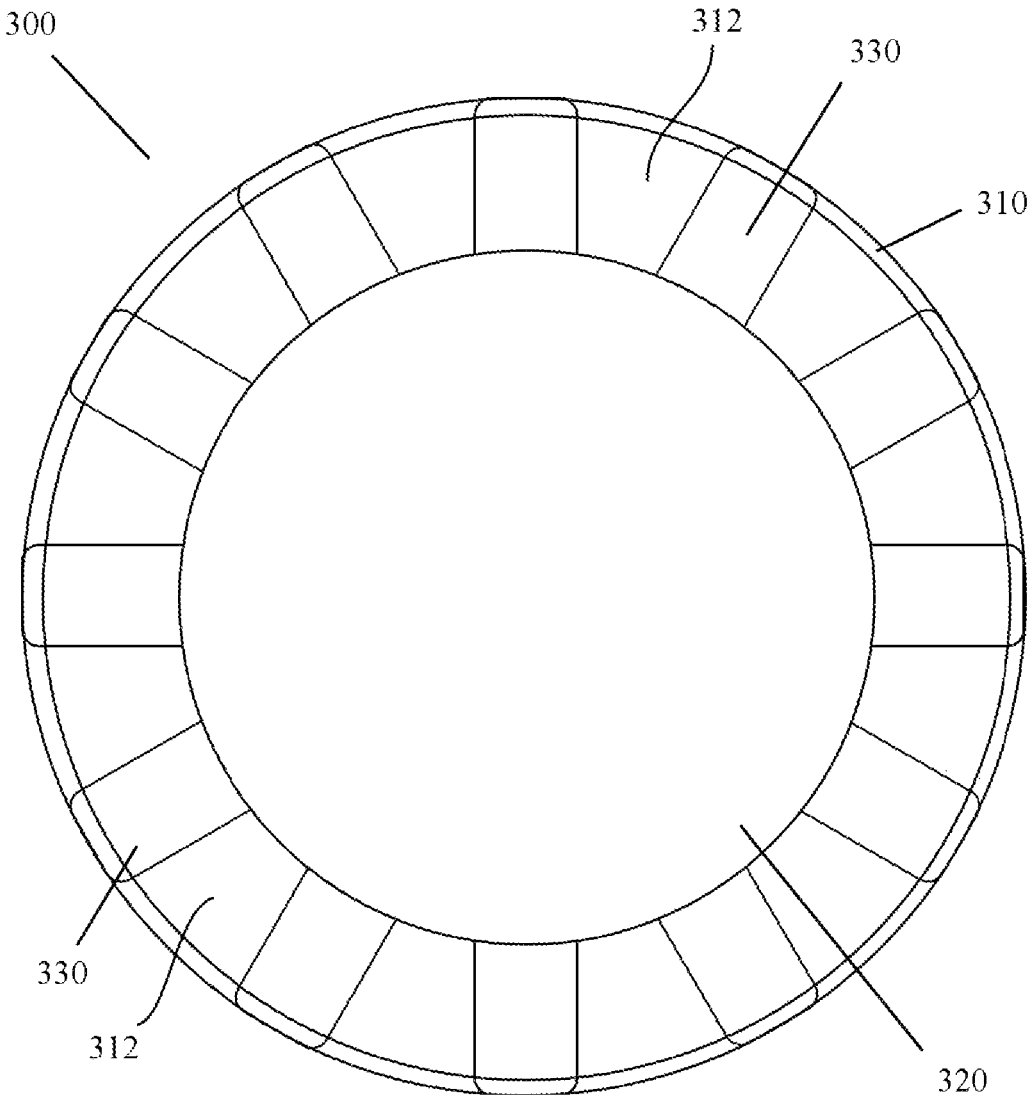
FIG. 5 is a top view of the spring ring device without a shell in accordance with a third embodiment of the present invention.

FIG. 5 depicts a third embodiment of the device 300. This embodiment of the device 300 is based on the same concepts as the first and second embodiments but utilizes a different configuration of components. The device 300 generally includes a ring 310, a plate 320, at least one flexible link 330, and a shell. While the ring 310, plate 320, and flexible link 330 are depicted in FIG. 5, the shell is not depicted.

The third embodiment of the device 300 includes a ring 310. The ring 310 acts as a spring in order to provide the device 300 with the capability to rebound and bounce off hard surfaces. In a preferred embodiment, the ring 310 is constructed out of a lightweight material with a high elasticity to provide the springing capabilities. For example, the ring 310 may be constructed out of fiberglass, plastics, and certain types of metal alloys having a high elasticity. While the listed materials may be used to construct the ring 310, any material having sufficient elasticity to spring off hard surfaces may be utilized without departing from the concepts disclosed herein.

The ring 310 may be circular in shape when viewed from the top, as shown in FIG. 5. In a preferred embodiment, the ring 310 is circular with an open space in the center when viewed from above. The ring 310 may be a torus shape, a straight-edge hollow cylinder shape, or any other shapes and combinations of the aforementioned. The ring 310 is further configured to have an open space in the central area of the ring 310.

The ring 310 may be any diameter and any thickness so long as it remains lightweight enough to maintain flight and glide while simultaneously keeping a high coefficient of restitution, allowing it to bounce off hard surfaces and maintain its shape. Any area density may also be utilized without departing from the concepts disclosed herein. As with the first and second embodiments, the optimal area density for the ring 310 to achieve the longest bounce and flight performance is between 1.2 $g/cm^2$ and 1.5 $g/cm^2$. Thus, in preferred embodiments, the diameter and weight of the ring 310 fits within this ratio.

The device 300 also includes a plate 320. The plate 320 may be circular in shape when viewed from the top, as shown in FIG. 5. In a preferred embodiment, the plate 320 forms a concentric circle within the ring 310 when viewed from the top. The plate 320 is placed inside open space in the central area of the ring 310. As such, the diameter of the plate 320 must be less than the diameter of the ring 310 such that the plate 320 is capable of sitting within the open space in the central area of the ring 310.

The materials used for the plate 320 should preferably be flexible, durable, and lightweight. For example, possible materials for the plate 320 include plastics, rubbers, and other composites such as fiberglass or carbon fiber. Other materials may also be used without departing from the concepts disclosed herein.

The device 300 also includes at least one flexible link 330. In a preferred embodiment, the device 300 may have a plurality of flexible links 330. In other embodiments, the device 300 may have a single flexible link 330 spanning the gap between the ring 310 and the plate 320. The at least one flexible link 330 is configured to connect the ring 310 to the plate 320. The at least one flexible link 330 acts as a type of shock absorber to absorb some of the force of the impact of the device 300 when impacting a hard surface, such that the device 300 will maintain its shape and continue flying and gliding after impact. Thus, while the plate 320 provides the capability of the device 300 to fly and glide, the ring 310 and at least one flexible link 330 provide the elasticity to all the device 300 to bounce and rebound off hard surfaces while maintaining its shape, thereby allowing the flight of the device 300 to continue.

The at least one flexible link 330 may be constructed of any material capable of connecting the ring 310 to the plate 320. In preferred embodiments, the at least one flexible link 330 is constructed out of a highly elastic material, such that the at least one flexible link 330 is able to provide additional shock absorption upon impact and aid the device 300 in maintaining its original shape immediately after impact.

The shell for the third embodiment will follow the same concepts as disclosed for the first embodiment, such that the shell is configured to cover substantially all the ring 310, plate 320, and flexible link 330 to protect the components of the device 300 and provide additional grip for the player. The shell is configured to cover the top portion of the ring 310 and the at least one flexible link 330 and may cover any top portion of the plate 320 up to the entire plate 320. The shell may also be configured to cover the entirety of the device 300 at the top and the bottom of the device 300. The shell may also be configured to cover just a portion the top of the device 300, or anything in between.

To construct the device 300, the plate 320 is first placed within the central area of the ring 310, such that the ring 310 and plate 320 create concentric circles when viewed from above. Then the ring 310 and plate 320 are connected using the at least one flexible link 330 to create the shape and construction shown in FIG. 5. Lastly, the shell is attached covering the ring 310, plate 320, and at least one flexible link 330 to protect the device 300 upon impact. Once the device 300 is constructed, the device 300 may be thrown at a hard surface and maintain its flight and glide after impact to the hard surface. The device 300 can continue to fly and glide regardless of the number of hard surfaces impacted.

The spring ring device according to all three embodiments described above may be utilized in a number of different manners, including (1) new variations to existing games involving disc-type devices, (2) entirely new games involving the spring ring device, or (3) for numerous therapeutic uses. Disc games such as Kan-Jam™ disc golf and Ultimate FRISBEE™ lack a bouncing or ricochet component that would add another layer of complexity and skill to these games.

For example, one modification to the Ultimate FRISBEE™ game using the device disclosed herein would have two teams with 7 players each on a rectangular field with two goal zones, one at each end, the field measuring about 60 yards long and 25 yards wide. To start play, the players line up on their own goal line, and the defense throws the spring ring device to the offense. When the offense catches a pass in the defense's goal zone, they gain four points. The spring ring device can be thrown and advanced in any direction when a player catches, but players cannot am with the spring ring device. If the spring ring device is dropped, possession is switched, and the defensive team starts where the other team dropped the spring ring device and becomes the offense. This variation of Ultimate FRISBEE™ would be played in a gymnasium such that the walls of the gymnasium can be used in the game to pass the spring ring device around opponents. For each completed bounce pass off the wall, the offensive team gets a point. If the spring ring device is thrown or caught off the wall within five feet of the wall, it does not count as a point. Other similar variations may also be implemented using the spring ring device.

Another embodiment of a game that incorporates the spring ring device involves two targets on opposite ends of a play area. Different point amounts are distributed depending on accuracy. The targets are cylindrical, 2.5 feet tall, with a slot in the center of it that fits a specific embodiment of the spring ring device. Players stand 40 feet apart, with two players on each team. One player throws the spring ring device at the target, and the other player can redirect it. If a player throws it and their partner redirects it to hit the target, one point is awarded. If a player hits the target on their own, it is worth 2 points. If a player redirects their partners throw into the top of the target cylinder, it is worth three points. If the spring ring device goes through the slot, it is worth 10 points. The target can be hit straight on, no bounces off the standing walls required, or points can be doubled if a bounce is incorporated. A shot where the spring ring device goes through the slot after a bounce would be an instant win. There are two identical flat, smooth boards that stand vertically, facing each other at the 20-foot mark between targets. They stand 30 feet apart, so that the four components of the game, the two targets and two walls, form a parallelogram with four equal sides. The walls are meant for players to bounce the spring ring device off the walls. While specific sizes and point values are provided above, it is understood that variations may be utilized without departing from the general concepts disclosed herein.

Another important use for the spring ring device as disclosed relates to physical therapy and injury recovery. The spring ring device can be used to improve hand-eye coordination and reaction time for quick, direction change rehabilitation for physical therapy patients. There are many conditions that result in a loss of dexterity and/or reaction time. Conditions include but are not limited to (1) stroke (one sided weakness); (2) fracture of shoulder/elbow/hand (range of motion can decline when splinted or casted for multiple weeks without use); (3) multiple sclerosis (a chronic progressive loss of function that can affect coordination); (4) Parkinson's (most patients have tremors called pill rolling tremors that causes a decline in coordination and reflexes of arms/hands); (5) upper body extremity musculoskeletal injuries (bicep tendinitis and rotator cuff tear); and (6) adhesive capitis (frozen shoulder), among others.

The unique flight pattern and unpredictability of the spring ring device provides a novel recovery strategy for physical therapists and their patients suffering from a loss in dexterity or range of motion/reaction time. For example, stroke patients focus on hand eye coordination in their recovery. In the final stages of a patient's recovery, moving to the spring ring device as a training exercise will greatly improve hand-eye coordination. Due to the rebounding nature of the spring ring device, patients in recovery do not need assistance to use the spring ring device and would be able to do the exercise on their own.

Athletes in recovery would also benefit from the spring ring device, working on hand-eye coordination as well as quick direction changes post injury. When the spring ring device rebounds off of a wall back to a player, it will return to a player within their reach, resulting in a catchable return. However, the placement of the rebound will change, to the left or right of the player, or above or below the frame of the player. The unpredictability of where the spring ring device will rebound is an advantage for athlete recovery. Traditionally, a physical therapist will work with someone, throwing a ball above their head, to their sides, or below their waist (without disclosing their intended placement) to work on coordination and quick direction change recovery post injury. The spring ring device does not return to one predetermined location after each throw. Instead, it is more difficult to predict where it will rebound, mimicking the same unpredictability that the physical therapist attempts to generate. The spring ring device can also be used with more progressive diseases such as Amyotrophic Lateral Sclerosis, Multiple Sclerosis or other forms of Muscular Atrophy. This would focus more on maintaining skills and helping to slow the progression.

Exemplary embodiments of the present invention are described herein with reference to idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing.

What is claimed is:

1. A flying disc apparatus for bouncing against surfaces a hard surface in flight, the apparatus comprising:

a ring, the ring comprising a band having a top edge and a bottom edge, the ring defining a central area;

a plurality of flexible links extending inward from the ring, each of the plurality of flexible links spanning at least one open space, the plurality of flexible links having a plurality of terminal ends;

the plurality of flexible links each being coupled to the ring such that the plurality of terminal ends collectively define an inner circle;

a circular member contained within the inner circle against which the plurality of flexible links are biased; and wherein the plurality of flexible links and the at least one open space allow the circular member to move independently of the ring such that the apparatus maintains flight and glide after impacting the hard surface.

2. The apparatus of claim 1, wherein the ring and the plurality of flexible links are configured with a coefficient of restitution sufficient to retain a starting shape of the ring upon deforming when bouncing off the hard surface.

3. The apparatus of claim 1, wherein the ring and the plurality of flexible links comprise an elastic material.

4. The apparatus of claim 1, wherein the circular member comprises a fabric material.

5. The apparatus of claim 4, wherein the fabric material comprises a nylon fabric.

6. The apparatus of claim 4, wherein the circular member comprises a single unitary piece of material.

7. The apparatus of claim 1 wherein the ring is entirely enclosed by a ring shell.

8. The apparatus of claim 1 wherein the ring has an area density between 1.2 $g/cm^2$ and 1.5 $g/cm^2$.

9. A method of creating a flying disc apparatus for bouncing against a hard surface in flight, the method comprising the steps of:

forming a ring comprising a band having a top edge and a bottom edge, the ring defining a central area;

forming a plurality of flexible links having a plurality of terminal ends and configuring the plurality of flexible links to extend inward from the ring;

coupling the plurality of flexible links to the ring such that the plurality of terminal ends collectively define an inner circle;

providing a circular member contained within the inner circle against which the plurality of flexible links are biased; and configuring the plurality of flexible links such that the at least one open space allows the circular member to move independently of the ring such that the apparatus maintains flight and glide after impacting the hard surface.

10. The method of claim 9, further comprising the step of configuring the ring and the plurality of flexible links with a coefficient of restitution sufficient to retain a starting shape upon deforming when bouncing off the hard surfaces surface.

11. The method of claim 9, wherein the ring and the plurality of flexible links are each formed by an elastic material.

12. The method of claim 9, wherein the circular member is a fabric material.

13. The method of claim 12, wherein the fabric material comprises a nylon fabric.

14. The method of claim 12, wherein the circular member is formed by a single unitary piece of material.

15. The method of claim 9 further comprising the step of forming the ring entirely enclosed by a ring shell.

16. The method of claim 9 wherein the ring is formed to have an area density between 1.2 g/cm$^2$ and 1.5 g/cm$^2$.

17. A flying disc apparatus for bouncing against a hard surface and remaining in flight, the apparatus comprising:

a ring comprising a band having a top edge and a bottom edge, the ring defining a central area;

a circular member forming a concentric circle within the ring, the circular member disposed in a plane defined by the top edge, the circular member spaced inward from the ring such that at least one open space is disposed therebetween;

a plurality of flexible links extending inward from the ring, each of the plurality of flexible links spanning the at least one open space;

the plurality of flexible links each connecting the ring to the circular member such that the circular member is biased to a center position relative to the ring; and wherein the plurality of flexible links and the at least one open space allows the circular member to move independently of the ring such that the apparatus maintains flight and glide after impacting the hard surface.

18. The apparatus of claim 17 wherein the circular member comprises a plate having a diameter less than a diameter of the ring.

19. The apparatus of claim 17 wherein the circular member is flexible.

* * * * *